US005913767A

United States Patent [19]

Feldkamp et al.

[11] Patent Number: 5,913,767

[45] Date of Patent: Jun. 22, 1999

[54] WORM CENTRIFUGE WITH CENTRIFUGAL VALVE

[75] Inventors: Bernward Feldkamp, Wesel; Reinhold Boden, Pulheim; Brigitta Stender, Waldsiedlung, all of Germany

[73] Assignee: Baker Hughes (Deutschland) GmbH, Cologne, Germany

[21] Appl. No.: 08/852,272

[22] Filed: May 7, 1997

[30] Foreign Application Priority Data

May 7, 1996 [DE] Germany ..... 196 18 249

[51] Int. Cl.[6] ..... B04B 1/16

[52] U.S. Cl. ..... 494/4; 494/53; 494/84; 210/117; 210/145; 210/374; 210/380.1

[58] Field of Search ..... 210/97, 117, 145, 210/360, 369, 374, 380.1; 494/4, 11, 53, 84

[56] References Cited

U.S. PATENT DOCUMENTS 3,324,375 6/1967 Mauer ..... 494/11

4,541,929 9/1985 Janusch ..... 210/365

OTHER PUBLICATIONS

GP Patent Specification 614,501, Jul. 1946.

*Primary Examiner*—David A. Reifsnyder
*Attorney, Agent, or Firm*—Carl A. Rowold

[57] ABSTRACT

A worm centrifuge for separating solids/liquid mixtures is disclosed for overcoming the problems during start-up and shut-down processes that occur when quantity of a liquid is located or remains in the centrifuge drum, particularly the problem of the emergence of liquid at the solids discharge openings during the shut-down process. The inventive centrifuge includes at least one, preferably a plurality of, drum emptying openings distributed over the circumference of the face wall of the centrifuge drum and being positioned radially outside of the liquid discharge openings. The drum emptying openings are each radially crossed by a bore. The bores each include a centrifugal force valve having a spring-loaded closing member adapted to close the drum emptying opening at high drum speed (operating speed) and to open the drum emptying opening at low drum speed.

14 Claims, 3 Drawing Sheets

WORM CENTRIFUGE WITH CENTRIFUGAL VALVE

BACKGROUND OF THE INVENTION

1. Field of the Invention

The invention is directed to a centrifuge and more particularly to a worm centrifuge for separating solids/liquid mixtures. Worm centrifuges generally comprise a rotatably seated drum jacket and a conveyor worm rotatable therein with a deviating speed. The drum includes liquid outlet openings arranged in the face wall of the centrifuge drum and solids discharge openings at the other end of the centrifuge drum. The conveyor worm directs the solids toward the solids discharge openings.

Solid bowl worm centrifuges have a means for the central delivery of the solids/liquid mixture to be separated into the centrifuge drum. The solid bowl worm centrifuges also include discharge openings for the discharge of the light and heavy substances separated from one another. In particular, a plurality of liquid outlet openings are provided in and distributed around the circumference of the face wall of the centrifuge drum for the discharge of the liquid freed of the solids, and the other (usually conically tapered) drum end likewise comprises discharge openings distributed around the circumference at its periphery through which the solids conveyed by the conveyor worm within the drum (and largely freed of the liquid) are discharged.

2. Description of the Prior Art

A prior art worm centrifuge is disclosed, for example, in German Published Application 40 33 070. FIG. 1 of that reference shows a liquid ring formed within the centrifuge drum during operation of such a worm centrifuge. The inside diameter of this liquid ring is determined by the radial arrangement of the liquid outlet openings uniformly distributed around the circumference of the drum or by the height of radially adjustable weir plates. The weir plates permit adjustment of the liquid level or the pool depth. When shutting the worm centrifuge off (the shut-down process), the speed of the centrifuge drum diminishes until the centrifuge achieves a standstill and the centrifugal force thus also diminishes or is reduced during the shut-down process. Upon shut-down of the centrifuge drum, the drum reaches a speed at which the centrifugal force is lower than the force of gravity, and this results in the liquid ring within the centrifuge drum collapsing so that the filling level of the liquid within the centrifuge drum extends beyond the solids discharge openings. This causes the liquid to undesirably discharge—though only briefly—in a wave-like fashion at the solids discharge openings.

German Published Application 40 33 070 proposes that the weir plates of the liquid outlet openings can be adjusted radially outward during the shut-down process in order to reduce the pool depth of the liquid ring as quickly as possible. However, a substantial residual quantity of liquid still remains in the centrifuge drum. In particular, the liquid ring that has remained at the inside wall of the drum suddenly collapses before the operating standstill, and this residual quantity of liquid can undesirably depart the drum at the solids discharge side. Conversely, the liquid remaining in the centrifuge drum can, upon restart of the worm centrifuge, increase the mass moment of inertia of the rotor and thus make start-up and acceleration of the masses within the centrifuge more difficult.

One object of the invention is therefore to avoid these disadvantages of the prior art and provide a worm centrifuge that overcomes the problems during the start-up process and shut-down process that derive from the quantity of liquid situated in or remaining in the centrifuge drum. Particularly, one object of the invention is to overcome the problem of liquid discharging through the solids discharge openings during the shut-down process.

SUMMARY OF THE INVENTION

The invention is based on the idea, given worm centrifuges, of causing the above-described liquid ring situated or remaining in the centrifuge (and leading to problems during the start-up and shut-down process of the centrifuge) to disappear in the start-up and shut-down phase. To achieve such objectives, the inventive worm centrifuge includes at least one drum emptying opening arranged in the face wall of the drum radially outside the liquid outlet openings. Preferably, the centrifuge drum includes a plurality of drum emptying openings uniformly distributed over the circumference of the drum face wall and radially arranged outside the liquid outlet openings in order to be able to completely empty the centrifuge drum of remaining residual liquid. These drum emptying openings arranged in the face wall of the drum are each radially traversed by a bore in which a centrifugal force valve is disposed. The centrifuge force valve includes a spring-loaded valve body or closing member arranged in such a way that the closing member respectively closes the drum emptying opening at high drum speed (operating speed) and opens the drum emptying opening at low drum speed. The centrifugal force valve of the inventive worm centrifuge thus works exactly opposite reflux valves employed, for example, in disk separators that open the discharge openings for the heavy phase at high speed operation of the separators as a consequence of high centrifugal force and product load. Exactly contrary to the operation of such devices, the integrated centrifugal force valve in the inventive worm centrifuge closes with the occurrence of high centrifugal force.

In an embodiment, the closing member of the centrifugal force valve can be comprised of a piston slide that is introducible into a blind bore adjoining the drum emptying opening in the face wall of the drum and being positioned radially inside the drum emptying opening. The piston slide can move back and forth therein piston-like under the influence of the force of a spring as well as the centrifugal force built up during centrifuge operation. The piston slide thereby is slidably movable to open or close the transverse drum emptying opening. The spring is preferably a prestressed compression spring arranged in the drum end wall radially outside the drum emptying opening and may comprise for example a helical spring. The spring has an elastic spring force—which builds up the counter-force to the centrifugal force of the centrifuge—matched to the opening speed at which the valve piston slide is moved radially inward and thereby releases or opens the respective drum emptying opening during the shut-down process of the centrifuge.

During the shut-down process of the worm centrifuge (i.e., from the time a specific, reduced speed of the centrifuge drum is reached until standstill), the centrifugal force that acts on the closing member of the centrifugal force valve is reduced. Accordingly, the closing member—as a result of the force of the tensed compression spring—moves radially inward and thereby more or less suddenly releases or opens the drum emptying opening (or the plurality of openings distributed over the circumference) so that the centrifuge drum is emptied of residual, remaining liquid. Thus, the risk that this remaining quantity of liquid will undesirably slop out at the solids discharge openings is no longer present. Conversely, the drum emptying openings are held open during the start-up process under the influence of the spring-loaded centrifugal force valve until a specific operating speed is reached. Accordingly, the startup of the worm centrifuge or the acceleration of the rotor is not impeded by a quantity of residual liquid remaining in the drum.

BRIEF DESCRIPTION OF THE DRAWINGS

The invention and further features and advantages thereof are explained in greater detail on the basis of the exemplary embodiment schematically shown in the following Figures.

DESCRIPTION OF THE PREFERRED EMBODIMENT

Figure 1:
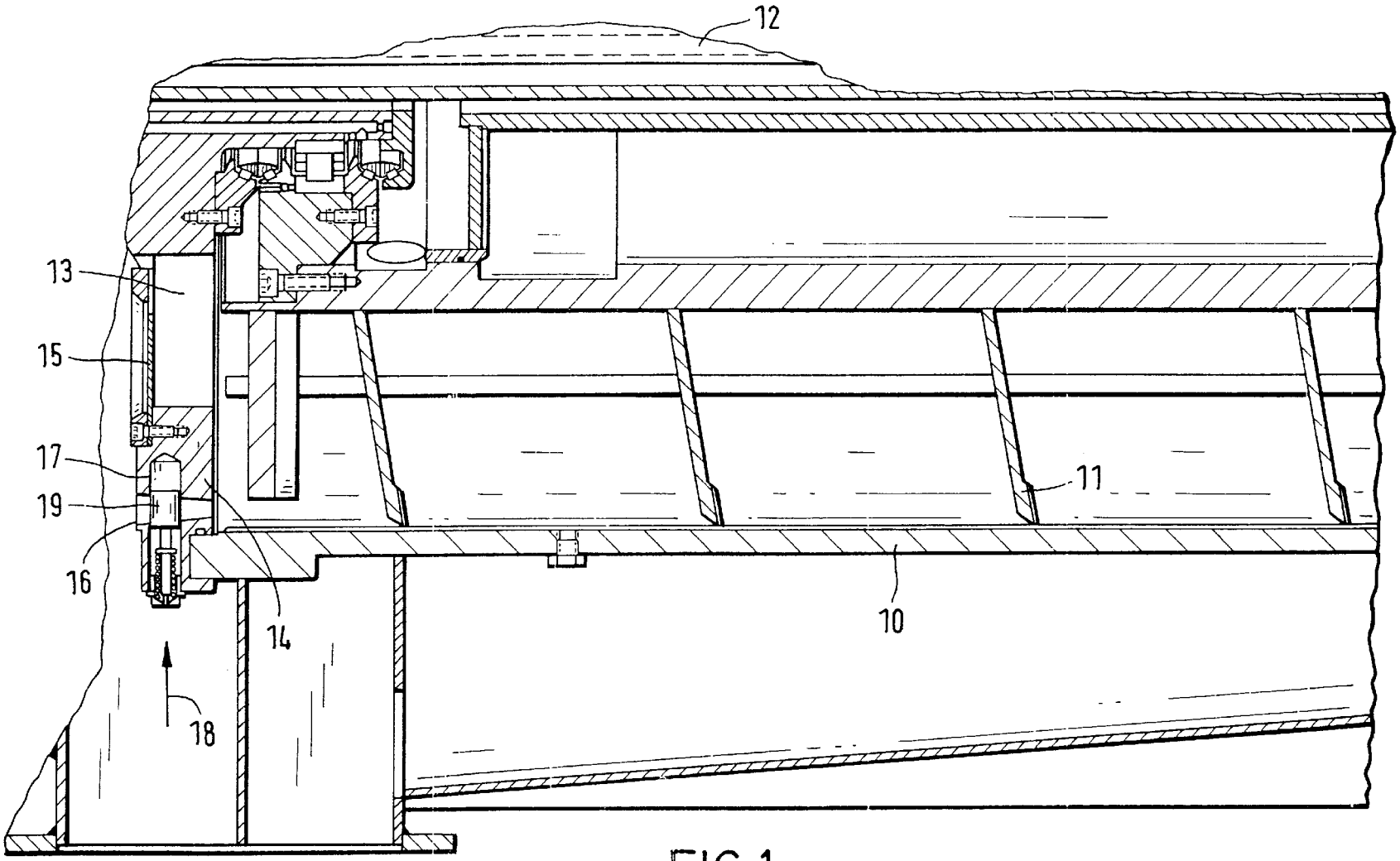
FIG. 1 is a longitudinal sectional view of a worm centrifuge for separating solids/liquid mixtures; the drawing illustrates an excerpted view of the region of the drum end at which the liquid (freed from the solids) runs off from the centrifuge drum.

As FIG. 1 shows, the inventive worm centrifuge comprises a drum jacket 10 with a worm conveyor provided with volutions 11 coaxially arranged therein. The worm conveyor 11 rotates in the same rotational sense as the centrifuge drum 10 but with a speed deviating therefrom. The solids/liquid mixture to be dewatered (such as, for example, sewage sludge) is introduced into the centrifuge drum via the central delivery pipe 12. During operation of the worm centrifuge, a liquid ring is formed within the centrifuge drum 10 under the influence of the centrifugal force. The heavy material in the liquid ring is transported therefrom toward the right with the assistance of the conveyor worm 11 and being conveyed via the usually conical drum end to the solids discharge openings (not shown in FIG. 1). In contrast, the liquid (centrate) freed from the solids runs off out of the centrifuge drum via liquid outlet openings 13 that are arranged and uniformly distributed around the circumference in the drum end wall 14 attached at the left-hand drum end. The inside diameter of the liquid ring forming in the centrifuge drum 10 is determined by the height position of the weir plates 15 that partly cover the liquid outlet openings at the outside.

After the shutdown of the worm centrifuge, a considerable quantity of residual liquid remains within the centrifuge drum. This presents the above-described problems both during the shut-down process as well as during the restart of the worm centrifuge.

The present invention eliminates these problems by providing the centrifuge with at least one, preferably a plurality of, drum emptying openings 16. The drum emptying openings 16 are distributed over the circumference and are arranged in the drum face wall 14 radially outside the liquid discharge openings 13. The openings 16 are radially crossed or traversed by a bore 17 in which a centrifugal force valve 18 is introduced.

Figure 2:
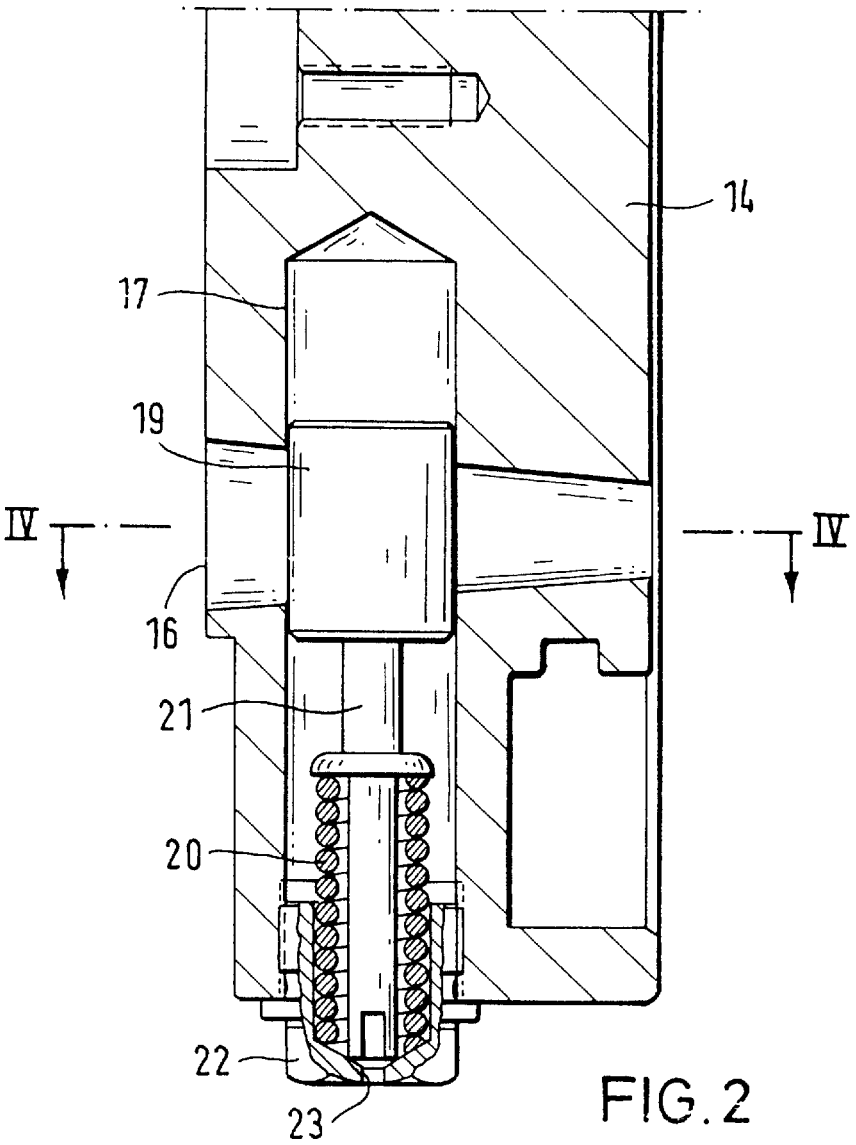
FIG. 2 is an enlarged partial cross-sectional view illustrating the centrifugal force valve arranged in the periphery of the end wall of the centrifuge drum for emptying the drum, shown in closed valve position.
Figure 3:
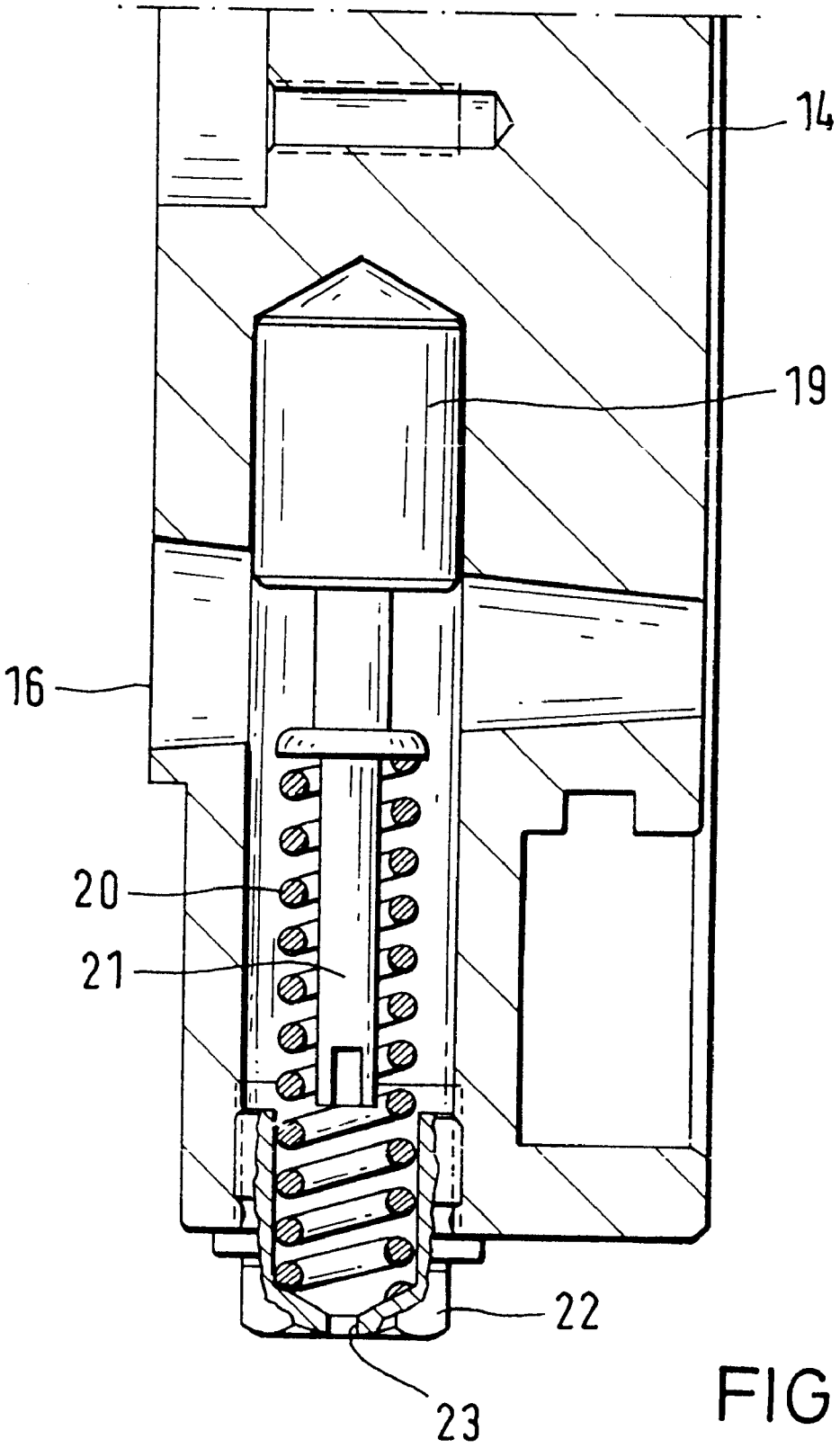
FIG. 3 is a partial cross-sectional view illustrating the centrifugal valve of FIG. 2 in the valve position that releases or opens the drum emptying opening.

The centrifugal force valve 18 is provided with a spring-loaded closing member in such a way that the closing member closes the drum emptying opening 16 at high drum speed (operating speed) and opens the drum emptying opening 16 at low drum speed. The centrifugal force valve 18 is shown in FIG. 1 in its position that closes the drum emptying opening 16. FIG. 2 is an enlarged view showing the centrifugal force valve 18 in the closed position. FIG. 3 shows the centrifugal force valve 18 in its position that opens the drum emptying opening 16.

Figure 4:
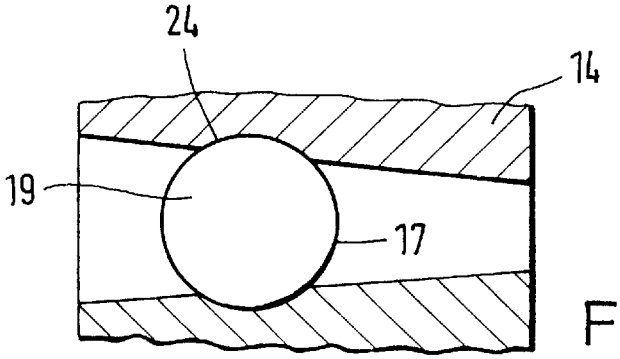
FIG. 4 is a partial cross sectional view taken along the line IV—IV of FIG. 2.

As can be clearly seen in FIGS. 2 through 4, the closing member of the centrifugal force valve 18 is composed of a piston slide 19 that, in terms of position, is positioned in its lower dead point in FIG. 2 and in its upper dead point in FIG. 3. The piston slide 19 is introducible into a blind bore 17 adjoining the drum emptying opening 16 in the drum face wall 14 and is positioned radially inside of the drum emptying opening 16. The piston slide 19 can be moved back and forth piston-like in the bind bore 17 under the influence of the force of a spring 20 as well as of the centrifugal force built up during centrifuge operation. Under the influence of these forces, the piston slide 19 releases or opens the drum emptying opening 16 as shown in FIG. 3 or closes the opening 16 as shown in FIG. 2.

As shown in FIGS. 2 and 3, the spring 20 in this exemplary embodiment is a pre-stressed compression spring arranged in the drum face wall 14 radially outside the drum emptying opening 16. The spring 20 has a tension force which builds up the counter-force to the centrifugal force of the centrifuge and which is selected to match the opening speed at which the valve piston slide 19 is moved radially inward and thereby releases or opens the drum emptying opening 16 during the shut-down process of the centrifuge. When the worm centrifuge is turned off, the speed of the centrifuge drum 10 diminishes until standstill and, thus, the centrifugal force is also reduced. During shut-down of the centrifuge drum 10, a speed is then reached at which the centrifugal force is lower than the force of gravity, with the result that the liquid ring forming in the centrifuge drum collapses. In the inventive worm centrifuge, however, this collapsing liquid ring no longer causes the above-described problems because the piston slides 19 of the centrifugal force valves 18 distributed over the circumference of the drum 10 are moved radially inward during this stage of the centrifuge operation and thus release or open the drum emptying openings 16 distributed over the circumference. By opening the drum emptying openings 16, the slowing centrifuge drum 10 is completely emptied of liquid. FIG. 3 shows the open position of the inventively arranged centrifugal force valves 18. Conversely, the piston slides 19 move radially outward only after a specific drum speed has been reached and only then do they close the drum emptying openings 16 when the centrifuge is restarted.

FIGS. 2 and 3 also reveal that the valve spring 20 surrounding the piston rod 21 of the piston slide 19 has a radially outwardly disposed end supported in a cap-like closing screw 22. The closing screw 22 is screwed into the end face of the drum end wall 14 proceeding from the circumference and being positioned radially relative to the centrifuge axis. The radially outwardly positioned head of this cap-shaped closing screw 22 advantageously includes a through bore 23 for liquid outlet and for self-cleaning of the centrifugal force valve 18 with self-cleaning of the threads of the helical spring 20.

The piston slide 19 of the centrifugal force valve 18 has a secure detent both in the lower dead point (FIG. 2) as well as in the upper dead point (FIG. 3), so that a stable valve position is established both in the closed condition as well as in the opened condition. In addition, the cylindrical part of the slide body 19 in the exemplary embodiment is pressed against the guide surface by the pressure prevailing in the centrifuge drum 10, so that the remaining gap 24 between piston slide 19 and the wall of the blind bore 17 is reduced to practically zero, as FIG. 4 reveals.

Fundamentally, there is also the possibility of combining or, respectively, uniting the liquid outlet openings 13 and the drum emptying openings 16 together with the centrifugal force valves 18.

Although the present invention has been described with reference to a specific embodiment, those of skill in the art will recognize that changes may be made thereto without departing from the scope and spirit of the invention as set forth in the appended claims. For example, the valve means for opening and closing the drum emptying opening could include any one of a number of valve devices (a centrifugal force valve in the preferred embodiment described above) for accomplishing the function of opening and closing the openings.

We claim as our invention:

1. A centrifuge for separating solid/liquid mixtures comprising:

a rotatably seated centrifuge drum having a face wall including a plurality of liquid outlet openings;

a conveyor worm rotatably mounted within said centrifuge drum and being capable of having a deviating speed with respect to said centrifuge drum;

at least one drum emptying opening arranged in said face wall radially outward of said liquid outlet openings;

at least one bore in said face wall extending transversely to said at least one drum emptying opening; and at least one centrifugal force valve disposed in said at least one bore and having a spring-loaded closing member adapted to close said at least one drum emptying opening at relatively high drum speed and to open said at least one drum emptying opening at relatively low drum speed.

2. The centrifuge according to claim 1 in which said at least one bore comprises a blind bore having an end wall adjoining said drum emptying opening and being positioned radially inward of said drum emptying opening, and said closing member comprises a piston slide slidably disposed in said blind bore and including a spring, and said piston slide is movable within said blind bore under the influence of said spring as well as a centrifugal force built up by operation of the centrifuge such that said piston slide is movable to open and close said drum emptying opening.

3. The centrifuge of claim 2 in which said spring is a pre-stressed compression spring arranged in said face wall radially outside said drum emptying opening and opposing the centrifugal force of the centrifuge, said spring having a tensing force selected to move said piston slide radially inward and open said drum emptying opening during the shut-down process of the centrifuge.

4. The centrifuge of claim 2 in which said piston slide includes a piston rod extending through said spring, and said spring has a radially outwardly disposed end supported in a cap-like closing screw screwed into an end face of said face wall.

5. The centrifuge of claim 4 in which said closing screw includes a through bore for acting as a liquid outlet and for self-cleaning on the centrifugal force valve.

6. The centrifuge of claim 1 in which said centrifuge includes a plurality of drum emptying openings and a corresponding plurality of centrifugal force valves uniformly distributed over a circumference of the centrifuge and arranged in said drum face wall of said centrifuge drum.

7. A centrifuge for separating solid/liquid mixtures comprising:

a centrifuge drum mounted to rotate about a longitudinal axis and having a face wall extending generally perpendicular to said axis and including a plurality of liquid outlet openings in said face wall;

a conveyor worm rotatably mounted within said centrifuge drum;

at least one drum emptying opening disposed in said face wall of said centrifuge drum; and valve means provided in said face wall of said centrifuge drum for closing said at least one drum emptying opening during high speed operation of said centrifuge drum and for opening said drum emptying opening during low-speed operation of the centrifuge drum.

8. The centrifuge of claim 7 in which said valve means comprises a centrifugal force valve having a piston slide disposed in a blind bore extending transverse to said at least one drum emptying opening.

9. The centrifuge of claim 8 in which said piston slide includes a piston slidably mounted in said bore and a spring disposed around said piston, said spring having a spring force selected to move said piston radially inward and to open said at least one drum emptying opening during shut-down process of the centrifuge.

10. The centrifuge according to claim 9 in which said spring has a radially outwardly disposed end supported in a closing screw secured into an end face of said face wall of said centrifuge drum.

11. The centrifuge according to claim 10 in which said closing screw includes means for draining liquid and for self-cleaning of the centrifugal force valve.

12. The centrifuge according to claim 8 in which said centrifuge drum includes a plurality of said drum emptying openings uniformly distributed over a circumference of said face wall of said centrifuge drum.

13. A centrifuge for separating solid/liquid mixtures comprising:

a centrifuge drum mounted to rotate about a longitudinal axis and having a face wall extending generally perpendicular to said axis and including at least one liquid outlet opening in said face wall;

a conveyor worm rotatably mounted within said centrifuge drum;

at least one drum emptying opening disposed in said face wall of said centrifuge drum radially outward of said liquid outlet opening and extending transversely through said face wall; and a centrifugally operated valve in said face wall of said centrifuge drum operable to open said at least one drum emptying opening during relatively low-speed operation of said centrifuge drum and to close said drum emptying opening during relatively high-speed operation of said centrifuge drum; said centrifugally operated valve comprising a moveable valve member mounted for generally radial movement between an open position enabling fluid flow through said drum emptying opening and a closed position blocking flow through the drum emptying opening in response to the speed of rotation of the centrifuge drum.

14. The centrifuge according to claim 13, wherein said valve includes a blind bore extending generally radially to said axis in said face wall and said movable valve member includes a spring loaded piston slide positioned in said blind bore, wherein centrifugal forces operate on said piston slide during high-speed operation to urge said piston slide radially outwardly against a restoring force of said spring to close said drum emptying opening and wherein, during low-speed operation, said spring urges said piston slide radially inwardly to open said drum emptying opening.

* * * * *